US012479483B2

(12) United States Patent
Wait

(10) Patent No.: US 12,479,483 B2
(45) Date of Patent: Nov. 25, 2025

(54) METHODS AND SYSTEMS FOR DETERMINING HYBRID TRAIN CONFIGURATIONS

(71) Applicant: Progress Rail Locomotive Inc., LaGrange, IL (US)

(72) Inventor: Keith Wait, Flower Mound, TX (US)

(73) Assignee: Progress Rail Locomotive Inc., LaGrange, IL (US)

( * ) Notice: Subject to any disclaimer, the term of this patent is extended or adjusted under 35 U.S.C. 154(b) by 95 days.

(21) Appl. No.: 18/506,551

(22) Filed: Nov. 10, 2023

(65) Prior Publication Data

US 2025/0153749 A1 May 15, 2025

(51) Int. Cl.

*B61L 27/16* (2022.01)
*B61L 15/00* (2006.01)
*B61L 27/12* (2022.01)

(52) U.S. Cl.

CPC ..... *B61L 27/16* (2022.01); *B61L 15/009* (2013.01); *B61L 27/12* (2022.01)

(58) Field of Classification Search

CPC ..... B61L 27/16; B61L 27/12; B61L 15/009
USPC ..... 701/19–20
See application file for complete search history.

(56) References Cited

U.S. PATENT DOCUMENTS

| | | | |
|---|---|---|---|
| 6,230,496 | B1 | 5/2001 | Hofmann et al. |
| 9,193,268 | B2 | 11/2015 | Kumar |
| 10,829,104 | B2 | 11/2020 | Lavertu |
| 11,142,088 | B2 | 10/2021 | Deshpande et al. |
| 2007/0272116 | A1 | 11/2007 | Bartley et al. |

FOREIGN PATENT DOCUMENTS

| | | | | |
|---|---|---|---|---|
| AU | 2014241851 | A1 * | 9/2015 | ..... B60W 40/09 |
| CN | 113135208 | A | 7/2021 | |

* cited by examiner

*Primary Examiner* — Hai H Huynh

(57) ABSTRACT

In one instance, disclosed herein is a system for configuring a train having at least one hybrid locomotive, the system comprising at least one processor operative to: receive an anticipated train route; receive a provisional train configuration, the provisional train configuration including the at least one hybrid locomotive, wherein the at least one hybrid locomotive includes at least one internal combustion engine and at least one energy storage system; determine whether the provisional train configuration is capable of completely traversing the anticipated train route; and in response to determining that the provisional train configuration is capable of completely traversing the anticipated train route, prompt a graphical user interface to display a visual indication that the provisional train configuration is capable of completely traversing the anticipated train route.

20 Claims, 6 Drawing Sheets

METHODS AND SYSTEMS FOR DETERMINING HYBRID TRAIN CONFIGURATIONS

TECHNICAL FIELD

The present disclosure relates generally to the configuration of trains, and, more particularly, to methods and systems for determining a hybrid train configuration that includes one or more hybrid locomotives capable of propelling a train with two or more distinct sources of motive power.

BACKGROUND

A train is typically configured to include a particular composition of non-powered cars and powered locomotives. The train composition is selected according to various objectives, such as ensuring sufficient power to traverse a desired route, maintaining train safety, providing operational efficiency, and maximizing customer convenience. A train must include at least one locomotive to propel the cars included in the train's configuration. The quantity and types of locomotives selected for a train can depend on various factors, such as the weight of the train, the distance that the train must travel, or the grades of one or more segments of a route that the train must traverse.

Many modern locomotives are hybrid locomotives capable of propelling a train with two or more distinct sources of motive power. For example, a hybrid locomotive may include a fuel-consuming engine and an energy storage system (ESS). The engine can consume fuel to drive a generator that in turn produces electricity that can then be used to power one or more motors operatively coupled to the wheels of the locomotive. Additionally, or alternatively, the ESS can be discharged to power the same or different motors operatively coupled to the wheels of the locomotive and propel the locomotive similarly.

U.S. Pat. No. 10,829,104, issued to Lavertu on Nov. 10, 2020, describes an on-board control system for a hybrid vehicle, e.g., a train that includes a hybrid locomotive. The control system of the '104 patent can examine characteristics of an upcoming segment of a route that a vehicle employing the control system is traversing and determine what combination of motive power sources (e.g., only a fuel-consuming engine, only an ESS, or some combination of both) is necessary or desired for the vehicle to traverse the upcoming segment. However, the control system of the '104 patent is an on-board control system for managing a train currently in operation, and does not address, among other things, the configuration of a train that is not yet in operation.

The systems and methods of the present disclosure may solve one or more problems set forth above and/or other problems in the art. The scope of the protection provided by the present disclosure, however, is defined by the attached claims, and not by the ability to solve any specific problem.

SUMMARY

In one aspect, a system for configuring a train having at least one hybrid locomotive comprises at least one processor operative to: receive an anticipated train route; receive a provisional train configuration, the provisional train configuration including the at least one hybrid locomotive, wherein the at least one hybrid locomotive includes at least one internal combustion engine and at least one energy storage system; determine whether the provisional train configuration is capable of completely traversing the anticipated train route; and in response to determining that the provisional train configuration is capable of completely traversing the anticipated train route, prompt a graphical user interface (GUI) to display a visual indication that the provisional train configuration is capable of completely traversing the anticipated train route.

In another aspect, a method for configuring a train comprising at least one hybrid locomotive comprises: receiving an anticipated train route; receiving a provisional train configuration, the provisional train configuration comprising at least one hybrid locomotive including an internal combustion engine and an energy storage system including a battery system; determining whether the provisional train configuration is capable of completely traversing the anticipated train route; and in response to determining that the provisional train configuration is capable of completely traversing the anticipated train route, prompting a graphical user interface (GUI) to display a visual indication that the provisional train configuration is capable of completely traversing the anticipated train route.

In another aspect, a method of configuring a train comprising at least one hybrid locomotive comprises: receiving an anticipated train route; receiving a provisional train configuration, the provisional train configuration comprising at least one non-powered car and at least one locomotive; generating a recommended train configuration that is capable of completely traversing the anticipated train route, the recommended train configuration comprising the at least one non-powered car and at least one hybrid locomotive including an internal combustion engine and an energy storage system; and prompting a graphical user interface to display the recommended train configuration.

BRIEF DESCRIPTION OF THE DRAWINGS

The accompanying drawings, which are incorporated in and constitute a part of this specification, illustrate various exemplary embodiments and, together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
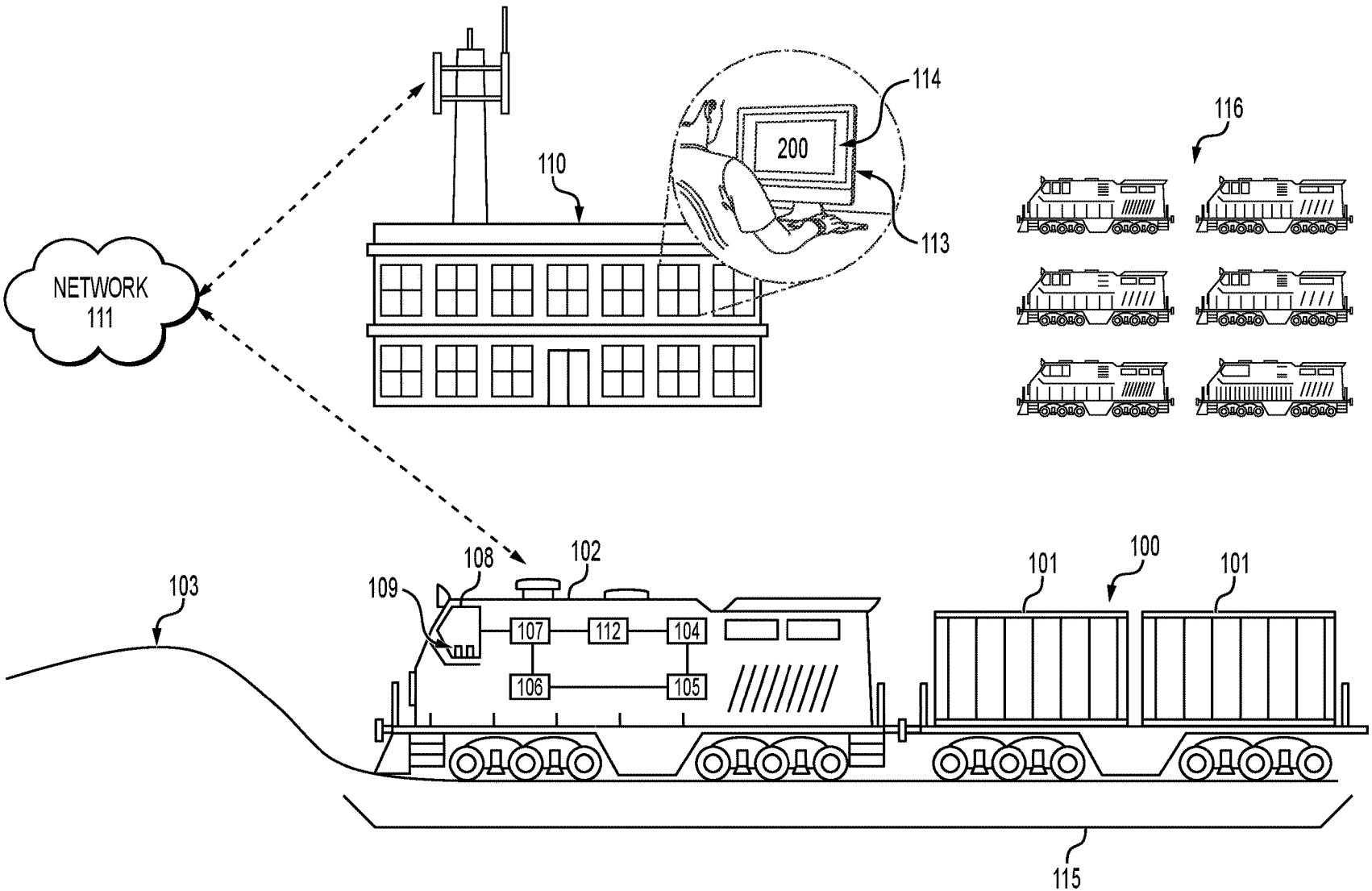
FIG. 1 illustrates a schematic view of hybrid train configuration system including an exemplary train traversing a train route.

FIG. 1 illustrates a schematic side view of a train 100 that includes a train configuration 115 having a hybrid locomotive 102 and one or more cars 101. A train 100 that includes a hybrid locomotive 102 may be referred to as a hybrid train. The cars 101 of train 100 may include freight cars or passenger cars, which are typically incapable of providing motive power to the train. Hybrid locomotive 102 has a primary purpose of providing motive power to the train. The hybrid locomotive 102 and cars 101 may be mechanically coupled such that the motive power provided by the hybrid locomotive 102 pulls or pushes the non-powered cars 101 forward or backward along a train route 103.

Hybrid locomotive 102 includes at least two distinct motive power sources, such as a primary motive power source and a secondary motive power source. The primary motive power source, or prime mover, of hybrid locomotive 102 may be an engine 104, e.g., an internal combustion engine. The engine 104 combusts fuel to generate a driving force on a shaft, which is in turn used to drive a generator 105, thereby producing electricity. The electricity produced by the generator 105 is then provided to one or more motors 106, operatively coupled to one or more wheels of the train 100, to drive the wheels in a desired direction.

The secondary motive power source of hybrid locomotive 102 may be an energy storage system (ESS) 107. The ESS 107 may include, for example, a battery system having a plurality of cells, modules, packs, and/or strings. It is understood, however, that the ESS 107 could take a different form, such as a hydrogen energy storage system. The ESS 107 may directly provide electricity to the one or more motors 106, which can, in turn, drive one or more wheels of the locomotive 102. Additionally, an ESS 107 may separately or simultaneously function as both a motive power source and an energy source for powering other components of the train 100, such as air conditioning and lighting systems. The battery system of ESS 107 may be charged or recharged in various ways, such as by generator 105, by an external charging source, or by regenerative braking. Regenerative braking may be accomplished by the one or more motors 106 functioning as generators when driven by the kinetic energy of the train 100. An ESS 107, such as a battery system, may have a capacity and a state of charge. The capacity of an ESS 107 refers to the maximum amount of energy that the ESS 107 is capable of storing. The state of charge of an ESS 107 refers to the current amount of energy that is stored by the ESS 107. The state of charge of an ESS 107 may be expressed in terms of an absolute amount of energy, e.g., 50 watt-hours, or relative to the capacity of the ESS 107, e.g., 50%.

As illustrated in FIG. 1, train 100 also includes a controller 112. In general, a controller 112 is a computing system that controls, directly or indirectly, some or all components of a train 100. Locomotive 102 may additionally include an operator compartment 108. The operator compartment 108 may include room for a human train operator and/or a control interface 109 that allows for a human train operator to access the controller 112 and manually control the train 100. It will be understood that the train 100 may additionally or alternatively be operated remotely, such as by an off-board operator, and/or autonomously or semi-autonomously. For example, as depicted in FIG. 1, an off-board operator at a railway operations center 110 may remotely control the train 100 using a graphical user interface 114 of an off-board control interface executed by a computing system 113 at the railway operations center 110 and communicatively coupled to the train 100, such as through a wired or wireless network 111.

The configuration 115 of a train 100 may be selected by railway operations personnel to include a particular composition and a particular sequence of hybrid locomotives 102 and cars 101 in order to enable the train 100 to accomplish various objectives, such as transporting a particular type or amount of cargo from a particular origin to a particular destination. To select an appropriate configuration 115 of a train 100, railway operations personnel typically require knowledge of the train's anticipated cargo, the train's anticipated route 103, and the types and amounts of train vehicles available. The types and amounts of railroad vehicles available to be included in the configuration 115 of a train 100 may be referred to as an available vehicle inventory 116. For example, when referenced with an available vehicle inventory 116, the types and amounts of a train's anticipated cargo may inform the types and amounts of non-powered cars 101 that will need to be included in the train's configuration 115. Similarly, for example, when referenced with an available vehicle inventory 116, the cumulative weight of the non-powered cars 101, as well as the length or maximum grade of the anticipated route 103, may inform the types and amounts of powered locomotives 102 that will be required in the train's configuration 115.

In some instances, railway operations personnel can select a train configuration 115 using one or more software systems, e.g., railway operations management software systems, which may be executed on a computing system 113 at a railway operations center 110. As noted above, the computing system 113 may include a graphical user interface 114, through which the railway operations personnel can access the one or more software systems. In some instances, a hybrid train configuration system 200 operative to assist railway operations personnel in selecting a train configuration 115 may be accessed through or executed on a computing system 113 and/or its graphical user interface 114, as described in further detail below. In some instances, the hybrid train configuration system 200 is installed and executed on a local computing system, e.g., computing system 113 at the railway operations center 110. The hybrid train configuration system 200 may be provided and executed remotely, for example, on a cloud computing system accessed by a local computing system. Additionally, or alternatively, the hybrid train configuration system 200 may be integrated into or otherwise accessed by a railway operations management software system, e.g., a software system used by railway operators to manage railway operations, such as train marshalling and traffic planning.

Figure 2:
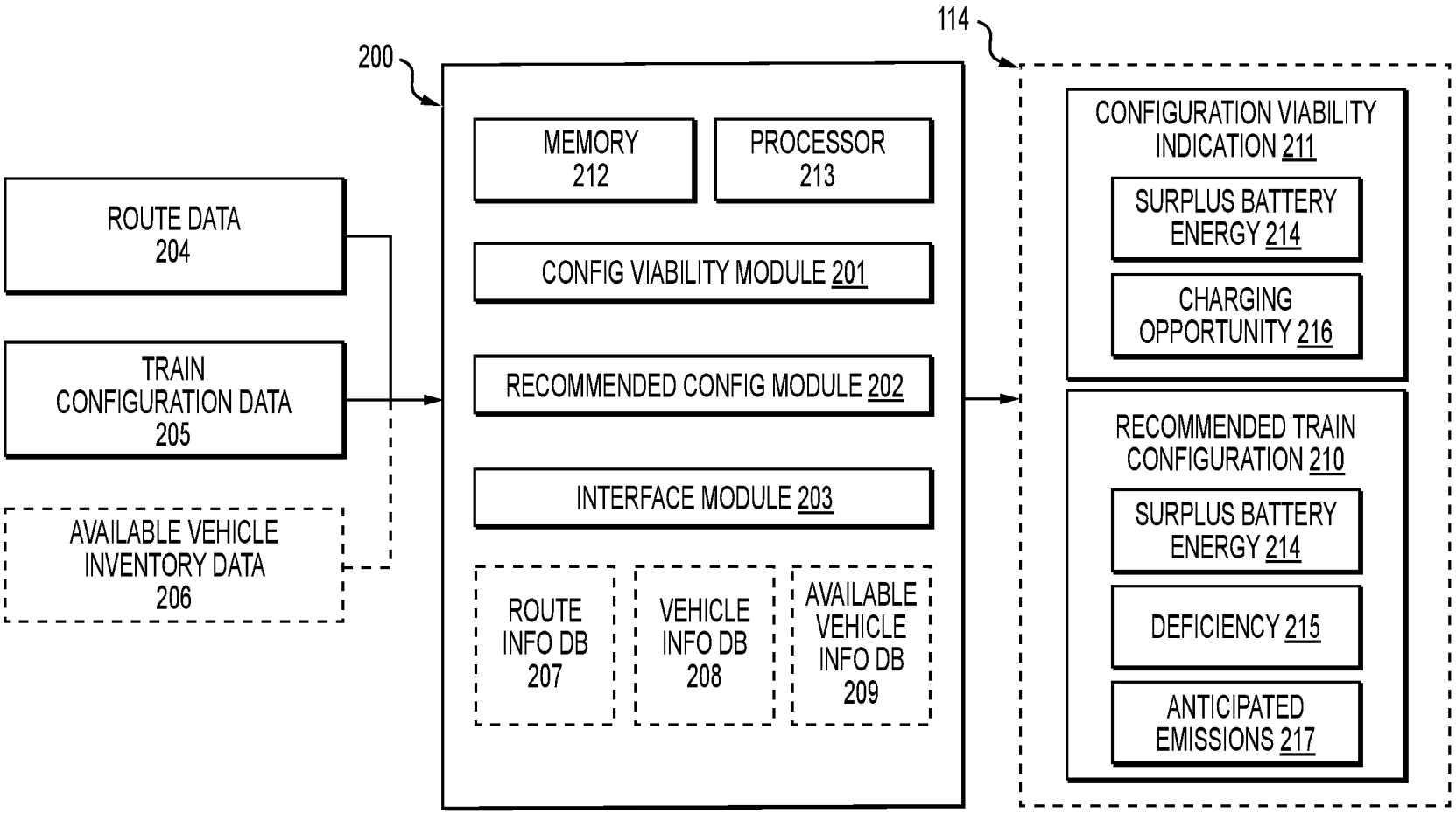
FIG. 2 depicts a schematic diagram of the hybrid train configuration system.

FIG. 2 depicts a diagram of a hybrid train configuration system 200. As depicted in FIG. 2, a hybrid train configuration system 200 includes one or more computer-readable memories 212 for storing data and computer-executable instructions and one or more processors 213 for accessing the data and executing the computer-executable instructions to provide one or more modules, such as a configuration viability module 201; a recommended configuration module 202; and an interface module 203. In general, the modules of the hybrid train configuration system 200 function cooperatively to receive route data 204, receive train configuration data 205, and determine a) whether a provisional train configuration 115 will be capable of completely traversing an anticipated train route 103 or b) which and how many locomotives 102 the provisional train configuration 115 should include to be capable of completely traversing the anticipated train route 103.

For example, as depicted in FIG. 2, the hybrid train configuration system 200 may receive route data 204, such as an anticipated train route 103 (as depicted in FIG. 1) including characteristics of the anticipated train route 103, and train configuration data 205, such as a provisional train configuration 115. Then, using the route data 204 and the train configuration data 205, the hybrid train configuration system 200 can determine, such as by employing the configuration viability module 201, whether a provisional train configuration 115 included in the train configuration data 205 will be capable of completely traversing an anticipated train route 103 included in the route data 204. If so, as depicted in FIG. 2, the hybrid train configuration system 200 can output a configuration viability indication 211 indicating that the provisional train configuration 115 is capable of completely traversing the anticipated train route 103 and prompt the graphical user interface (GUI) 114 to display a corresponding visual indication, e.g., by employing interface module 203. Or, for example, after receiving route data 204 and train configuration data 205, the hybrid train configuration system 200 can access available vehicle inventory data 206, such as from an available vehicle inventory 116. Then, using the route data 204, the train configuration data 205, and the available vehicle inventory data 206, the hybrid train configuration system 200 can generate, such as by employing the recommended configuration module 202, a recommended train configuration 210 that indicates which and how many hybrid locomotives 102 a provisional train configuration 115 included in the train configuration data 205 should include to be capable of completely traversing an anticipated train route 103 included in the route data 204. As depicted in FIG. 2, after generating a recommended train configuration 210, the hybrid train configuration system 200 can prompt a GUI 114 to display the recommended train configuration 210, such as by employing the Interface Module 203.

Route data 204 may include one or more characteristics of an anticipated train route 103, such as curvatures, grades, speed limits, or the like, as well as where those curvatures, grades, speed limits, etc. are located along the route 103. Route data 204 may additionally include a pacing plan that dictates particular times that a train 100 must arrive at or depart from particular locations along an anticipated train route 103. In some instances, route data 204 is included in, partially derived from, or wholly derived from one or more timetables provided to the hybrid train configuration system 200 by a user of the hybrid train configuration system 200. As used herein, a "timetable" refers to a list of origins, destinations, departing dates, and/or arrival dates of one or more trains 100.

Train configuration data 205 may include a composition and/or a sequence of a train configuration 115. For example, train configuration data 205 may include a quantity and a type of one or more powered hybrid locomotives 102, and a quantity and a type of one or more non-powered cars 101. Train configuration data 205 may additionally include one or more characteristics for each railroad vehicle included in a train configuration 115, such as a subtype of the railroad vehicle (e.g., a particular make or model of the hybrid locomotive 102 or non-powered car 101), the dimensions or weight of the vehicle, characteristics of the power sources included in the vehicles (e.g., maximum motive power output, maximum or current amount of fuel and/or battery level, battery capacity), etc. In some instances, one or more characteristics of a railroad vehicle (e.g., the continuous rated power or maximum hybrid power of a hybrid locomotive 102, as described below) are included in or derived from specifications provided by a manufacturer of the railroad vehicle. In some instances, one or more characteristics of a railroad vehicle are calculated or determined using performance data generated by or otherwise gathered from the operation of the railroad vehicle. For example, in some instances, the continuous rated power of a hybrid locomotive 102 may be determined by measuring and multiplying the tractive force delivered by the hybrid locomotive 102 and the resulting wheel velocity of the hybrid locomotive 102 during the operation of the hybrid locomotive 102. In some such instances, the tractive force and wheel velocity can be measured, multiplied, and averaged on a per-trip basis to dynamically track the achievable performance of the hybrid locomotive 102 over time, e.g., as the hybrid locomotive 102 degrades or undergoes maintenance.

Available vehicle inventory data 206 may include information regarding any and all railroad vehicles currently available to a railway system, e.g., available vehicles in a particular depot or railyard. Route data 204, train configuration 205, and/or available vehicle inventory data 206 may be submitted to the hybrid train configuration system 200 by an operator through a graphical user interface 114 (as depicted in FIG. 1), transmitted to the hybrid train configuration system 200 from an external or third-party source, or stored within one or more databases of the hybrid train configuration system 200, as described in further detail below. In some instances, available vehicle inventory data 206 is partially or wholly derived from one or more timetables, as described above. For example, for a particular depot or railyard, available vehicle inventory data 206 may be constituted by expected numbers of inbound or outbound vehicles as well as vehicles currently present at the depot or railyard and not yet selected to be included in a train configuration 115.

As depicted in FIG. 2, in some instances, a hybrid train configuration system 200 includes one or more databases, such as a route information database 207, a vehicle information database 208, or an available vehicle information database 209. In some instances, when the hybrid train configuration system 200 receives route data 204, the route data 204 may include only a route 103 and does not include characteristics of the route 103, e.g., curvatures, grades, speed limits, etc. In some such instances, when the hybrid train configuration system 200 receives route data 204, the hybrid train configuration system 200 may cross-reference the route 103 with the route information database 207 to determine one or more characteristics of the route 103. Similarly, in some instances, when the hybrid train configuration system 200 receives train configuration data 205, the data may not include all of the relevant characteristics of the railroad vehicles included in the train configuration 115, e.g., vehicle types, dimensions, weights, etc. In such instances, the hybrid train configuration system 200 may cross-reference the provisional train configuration 115 with the vehicle information database 208 to determine one or more additional characteristics of one or more railroad vehicles included in the train configuration 115. In some instances, when generating a recommended train configuration 210, as described below, the hybrid train configuration system 200 obtains available vehicle inventory data 206 from the available vehicle inventory database 209. In some instances, the vehicle information database 208 and the available vehicle inventory database 209 are one and the same.

As mentioned above, in various instances, the hybrid train configuration system 200 outputs a configuration viability indication 211 and/or a recommended train configuration 210. The hybrid train configuration system 200 can then prompt a GUI 114 to display the configuration viability indication 211 and/or the recommended train configuration 210. As depicted in FIG. 2, in some instances, as described in further detail below, a configuration viability indication 211 may include a surplus battery energy 214 and/or one or more charging opportunities 216. As depicted in FIG. 2, in some instances, as described in further detail below, a recommended train configuration 210 includes a surplus battery energy 214, one or more deficiencies 215, and/or an amount of anticipated emissions 217.

INDUSTRIAL APPLICABILITY

The hybrid train configuration system 200 disclosed herein finds applicability in virtually any railway system where hybrid locomotives are part of a train configuration. For example, the hybrid train configuration system can assist in properly selecting a hybrid train configuration for a particular train route.

Figure 3:
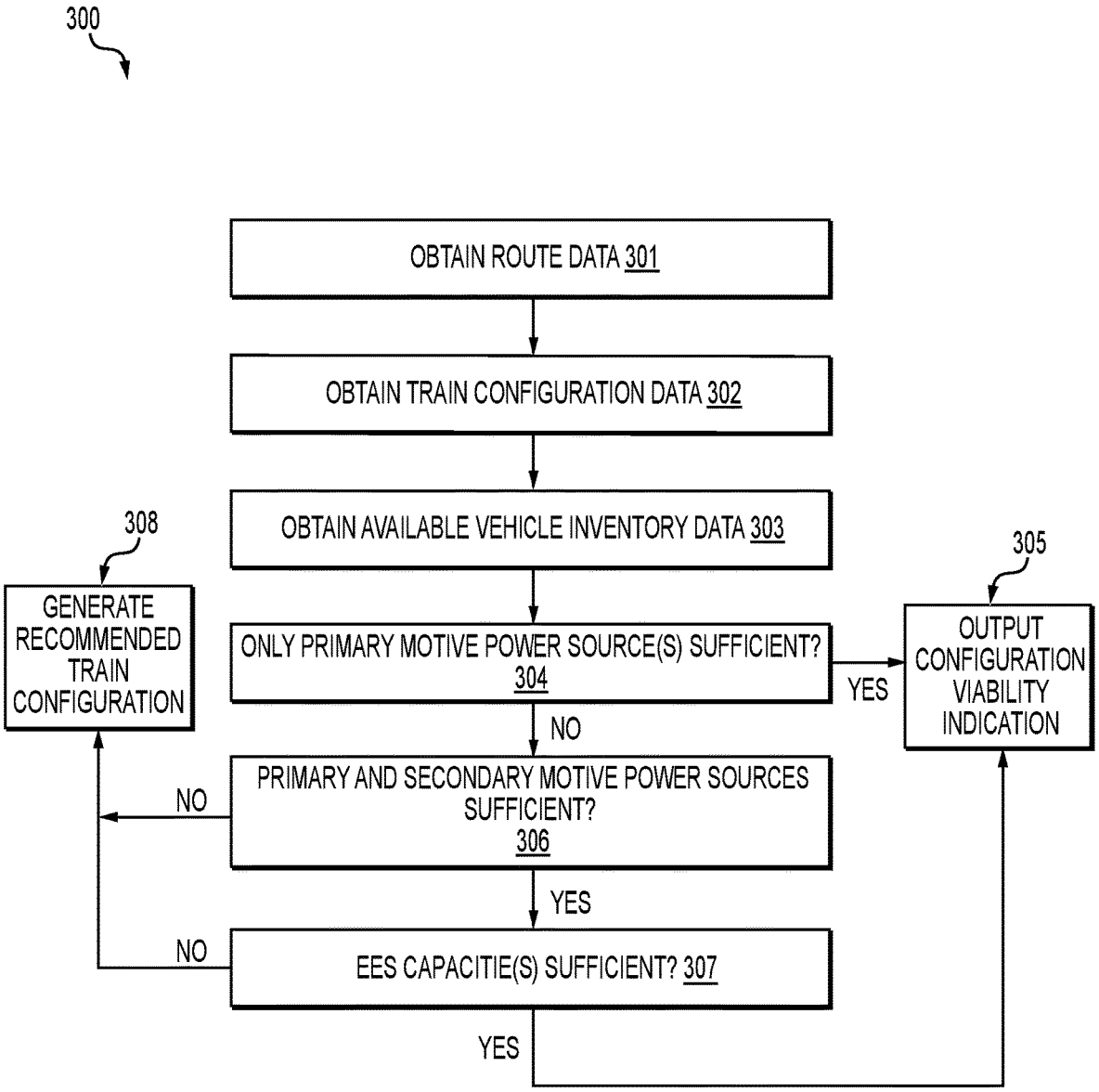
FIG. 3 depicts a flowchart of a method associated with the hybrid train configuration system.

FIG. 3 depicts a flowchart of a method 300 for selecting a train configuration 115 including at least one hybrid locomotive 102. As mentioned above, a train configuration 115 represents a particular composition and sequence of vehicles included in, or to be included in, a train 100, and does not necessarily represent an actual train. Accordingly, it will be understood that the analysis of a train configuration 115 such as the one depicted in the method 300 of FIG. 3 is not performed on-board a train 100 associated the train configuration 115, or during the operation of a train 100 associated with the train configuration 115, but, rather, during the planning of a train assembly or a route 103 that a train 100 is intended to traverse. For example, the method 300 depicted in FIG. 3 may be performed at a railway operations center 110 (as depicted in FIG. 1) before the assembly of any actual train. Applications of some features of the present disclosure for trains presently in operation are discussed below.

As used herein, a "provisional train configuration" refers to a proposed train configuration that has not been checked for viability to meet the demands of the desired train route, and a "recommended train configuration" refers to train that is deemed appropriate for the desired train route. Use of the phrase "train configuration" by itself may refer to either or both of a proposed train configuration or a recommended train configuration, depending on context.

In the example depicted in FIG. 3, the method 300 begins with steps 301 and 302, wherein a hybrid train configuration system 200 receives route data 204 including at least an anticipated train route 103 and train configuration data 205 including at least a provisional train configuration 115, respectively. In some instances, steps 301 and 302 are interchangeable, or occur simultaneously. In some instances, the method 300 continues with step 303, wherein the hybrid train configuration system 200 receives or obtains available vehicle inventory data 206, e.g., from a railway operations management software system accessing the hybrid train configuration system 200, or from an available vehicle inventory database 209 included in or otherwise accessible by the hybrid train configuration system 200, as described above. In some instances, steps 301, 302, and 303 are interchangeable, or occur simultaneously.

Figure 5:
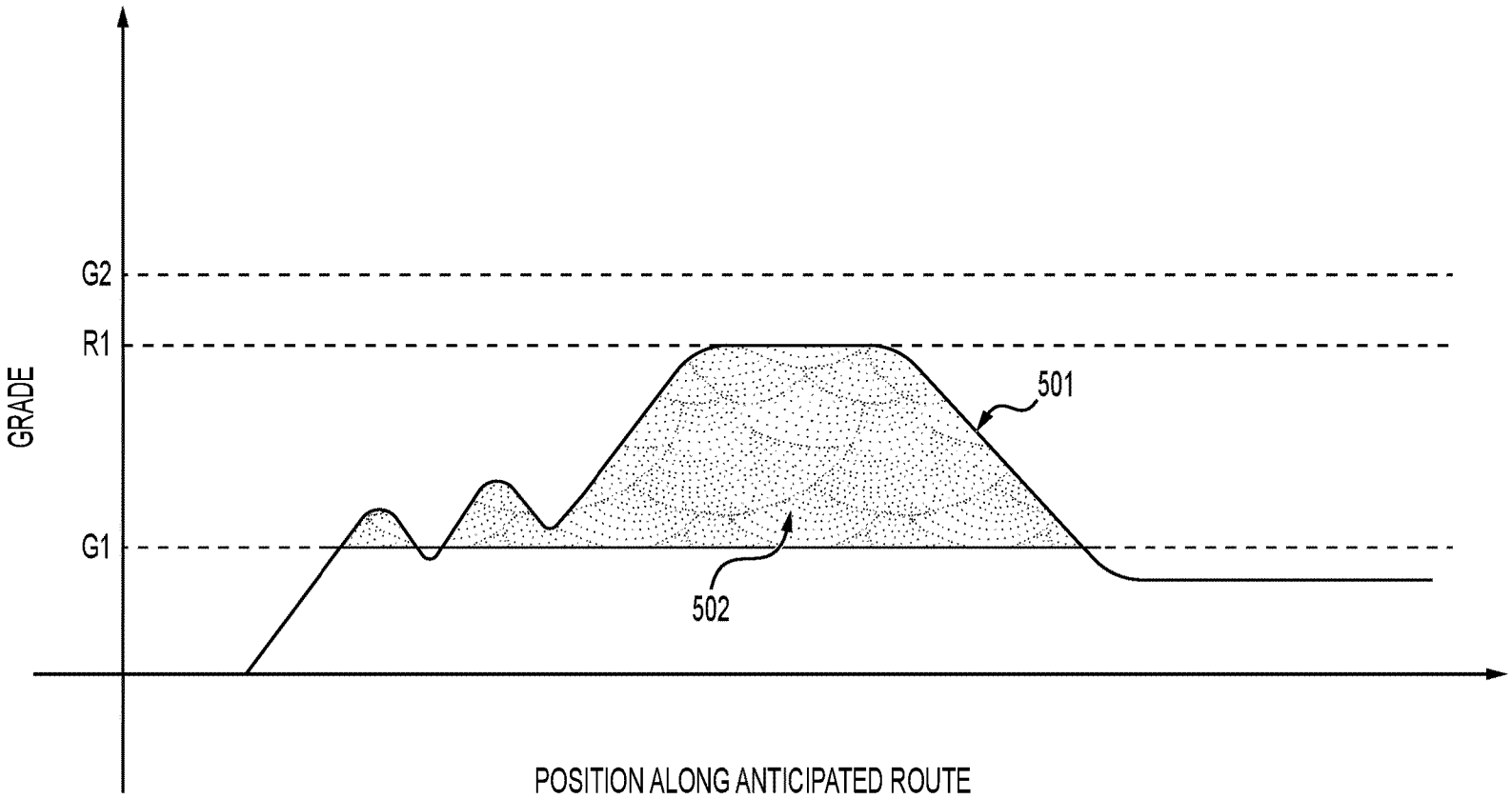
FIG. 5 depicts calculations of equivalent grades, in accordance with the methods of FIGS. 3 and 4.

Once the hybrid train configuration system 200 has received at least route data 204 and train configuration data 205, the method 300 continues with step 304, wherein the hybrid train configuration system 200 uses the route data 204 and the train configuration data 205 to determine whether locomotives 102, including at least one hybrid locomotive 102, included in a provisional train configuration 115 are capable of propelling the provisional train configuration 115 through an entire anticipated train route 103 using only the primary motive power source(s) of the locomotives 102, e.g., using only fuel-consuming engines 104 of the at least one hybrid locomotives 102. For example, the hybrid train configuration system 200 determines if the primary motive power source(s) of the locomotives 102 is capable of propelling the provisional train configuration 115 through the steepest graded segment of the anticipated train route 103. The steepest graded segment of a route 103 may be referred to as the "ruling grade" of the route 103. The ruling grade of a train route 103 may be referred to as "R1," as depicted in FIG. 5. A train configuration 115 will not be able to completely traverse a train route 103 if the train configuration does not include enough motive power to scale the ruling grade of the train route 103.

Figure 4:
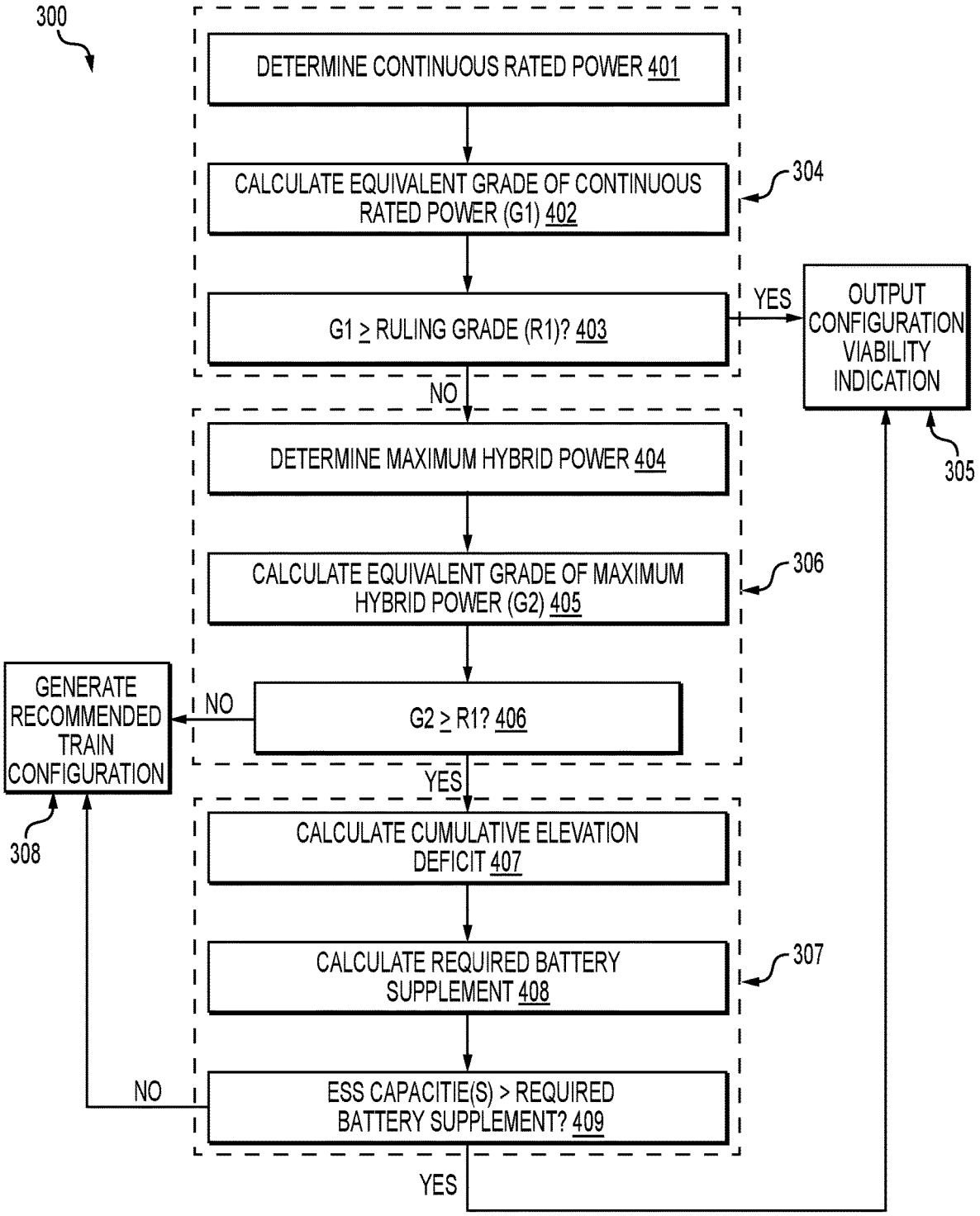
FIG. 4 depicts additional aspects of the method of FIG. 3.

For example, FIG. 4 depicts a particular and exemplary embodiment of portions of the method 300 depicted in FIG. 3. As depicted in FIG. 4, in some instances, the hybrid train configuration system 200 performs step 304 in three separate steps. In the first step, step 401, the hybrid train configuration system 200 determines the maximum motive power that the locomotives 102 included in the provisional train configuration 115 can produce using only the primary motive power source(s) of the locomotives 102. The maximum motive power that the locomotives 102 included in the provisional train configuration 115 can produce using only the primary motive power source(s) of the locomotives 102 may be referred to as the "continuous rated power" of the locomotives 102. The continuous rated power of a locomotive 102 may be included in the specifications of the locomotive 102.

In the example depicted in FIG. 4, in the second step, step 402, the hybrid train configuration system 200 calculates an equivalent grade of the continuous rated power. The equivalent grade of a continuous rated power may be referred to as "G1," as depicted in FIG. 5. An equivalent grade of a motive power of a train configuration 115 is the maximum grade that motive power of the train configuration 115 will allow the train configuration 115 to scale, given the weight of the train configuration 115. In some instances, for example, the hybrid train configuration system 200 calculates an equivalent grade of the continuous rated power of a provisional train configuration 115 using an equation for power, e.g., Power (P)=Force (F)*Velocity (V), and an equation for gravitational force, e.g., Gravitational Force ($F_g$)=20*grade (g)*Weight (W). Using these two equations, the equivalent grade of the continuous rated power can be calculated by dividing the continuous rated power by the product of 20, a standard minimum velocity, such as 10 mph, and the total weight of the provisional train configuration 115, i.e., g=P/(20*V*W).

In the example depicted in FIG. 4, in the third step, step 403, the hybrid train configuration system 200 determines the ruling grade (R1) of the anticipated train route 103 and determines if the equivalent grade (G1) of the continuous rated power is equal to or greater than the ruling grade (R1).

Figure 6:
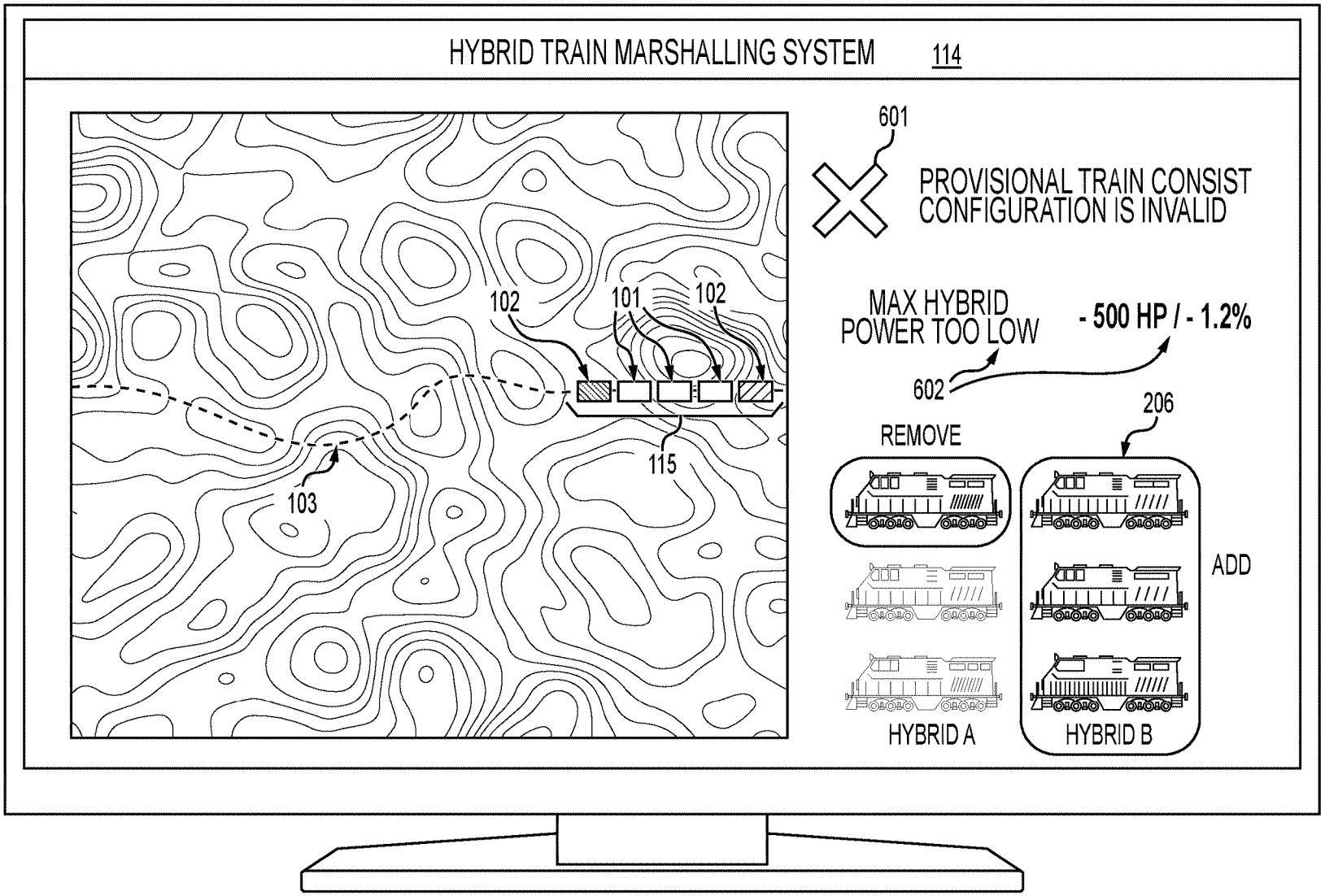
FIG. 6 illustrates a graphical user interface of the hybrid train configuration system.

As depicted in FIGS. 3 and 4, if the outcome of step 304 is yes, e.g., if the hybrid train configuration system 200 determines that the equivalent grade of the continuous rated power of the locomotives 102 included in the provisional train configuration 115 is greater than the ruling grade of the anticipated train route 103, the method 300 ends with step 305, wherein the hybrid train configuration system 200 outputs a configuration viability indication 211 indicating that the provisional train configuration 115 is capable of completely traversing the anticipated train route 103 and prompts a GUI 114 to display a corresponding visual indication 601 (as depicted in FIG. 6), as described below.

However, as depicted in FIGS. 3 and 4, if the outcome of step 304 is no, e.g., if the hybrid train configuration system 200 determines that the equivalent grade of the continuous rated power of the locomotives 102 included in the provisional train configuration 115 is less than the ruling grade of the anticipated train route 103, the method 300 continues with step 306, wherein the hybrid train configuration system 200 uses the route data 204 and the train configuration data 205 to determine whether the hybrid locomotives 102 included in the provisional train configuration 115 are capable of propelling the provisional train configuration 115 through the entire anticipated train route 103 using a combination of both the primary motive power source(s) of the locomotives 102 and one or more secondary motive power sources of the locomotives 102, e.g., using both fuel-consuming engines 104 and energy storage systems 107.

As depicted in FIG. 4, in some instances, the hybrid train configuration system 200 performs step 306 in three separate steps. In the first step, step 404, the hybrid train configuration system 200 determines the maximum motive power that the locomotives 102 included in the provisional train configuration 115 can produce using both the primary and secondary motive power sources of the locomotives 102. The maximum motive power that the locomotives 102 included in the provisional train configuration 115 can produce using both the primary and secondary motive power sources of the locomotives 102 may be referred to as the "maximum hybrid power" of the locomotives 102. For example, the hybrid train configuration system 200 may determine the maximum hybrid power of the locomotives 102 included in a provisional train configuration 115 by summing the motive power capable of being produced by each secondary motive power source included in the provisional train configuration 115 with the continuous rated power of the locomotives 102 included in the provisional train configuration 115.

In the example depicted in FIG. 4, in the second step, step 405, the hybrid train configuration system 200 calculates an equivalent grade of the maximum hybrid power. The equivalent grade of a maximum hybrid power may be referred to as "G2," as depicted in FIG. 5. In some instances, the hybrid train configuration system 200 calculates an equivalent grade of a maximum hybrid power using an equation for power and an equation for gravitational force, as described above.

In the example depicted in FIG. 4, in the third step, step 406, the hybrid train configuration system determines if the equivalent grade (G2) of the maximum hybrid power is equal to or greater than the ruling grade (R1) of the anticipated train route 103.

As depicted in FIGS. 3 and 4, if the outcome of step 306 is no, e.g., if the hybrid train configuration system 200 determines that the equivalent grade (G2) of the maximum hybrid power is less than the ruling grade (R1) of the anticipated train route 103, the method 300 continues with step 308, wherein the hybrid train configuration system 200 obtains available vehicle inventory data 206 (if the hybrid train configuration system 200 has not already done so) and uses the route data 204, the train configuration data 205, and the available vehicle inventory data 206 to generate a recommended train configuration 210 that is capable of completely traversing the anticipated train route 103, as described in further detail below. For example, the hybrid train configuration system 200 may generate a recommended train configuration 210 that includes all of the non-powered cars 101 included in the provisional train configuration 115, as well as a new set or combination of hybrid locomotives 102 that is capable of propelling the recommended train configuration 210 through the entire anticipated train route 103, e.g., using only primary motive power sources or using a combination of primary and secondary motive power sources. The hybrid train configuration system 200 can then prompt a GUI 114 to display the recommended train configuration 210, as described in further detail below. In some instances, when the hybrid train configuration system 200 generates a recommended train configuration 210 in response to determining that a provisional train configuration 115 is not capable of completely traversing an anticipated train route 103, the recommended train configuration 210 includes all of the non-powered cars 101 included in the provisional train configuration 115.

However, as depicted in FIGS. 3 and 4, if the outcome of step 306 is yes, e.g., if the hybrid train configuration system 200 determines that the equivalent grade (G2) of the maximum hybrid power is equal to or greater than the ruling grade (R1) of the anticipated train route 103, the method continues with step 307, wherein the hybrid train configuration system 200 determines whether the capacities of the secondary motive power sources are sufficiently large enough for the locomotives 102 to propel the provisional train configuration 115 through the entire anticipated train route 103.

As depicted in FIG. 4, in some instances, the hybrid train configuration system 200 performs step 307 in three separate steps. In the first step, step 407, the hybrid train configuration system 200 determines an elevation increase to be overcome by the secondary motive power source(s) by calculating and combining the difference between the equivalent grade (G1) of the continuous rated power and the ruling grade (R1) of the anticipated train route 103 at each incremental point along the anticipated train route 103 wherein the grade of the anticipated train route 103 is greater than the equivalent grade (G1) of the continuous rated power, i.e., along the entire anticipated train route 103, where the grade of the anticipated train route 103 is greater than G1, the hybrid train configuration system 200 integrates the marginal grade between G1 and the grade of the anticipated train route 103. The result of this calculation may be referred to as a "cumulative elevation deficit" 502, as depicted in FIG. 5.

In the example depicted in FIG. 4, in the second step, step 408, using an equation for gravitational force, as described above, the hybrid train configuration system 200 multiplies the cumulative elevation deficit 502 by twenty times the combined weight of the provisional train configuration 115 to yield a marginal increase in gravitational potential energy that must be produced by the secondary motive power source(s) of the locomotives 102 included in the provisional train configuration 115. The marginal increase in gravitational potential energy that must be produced by the secondary motive power source(s) of the locomotives 102 included in a provisional train configuration 115 may be referred to as a "required battery supplement," e.g., when the secondary power source 107 is a battery system.

In the example depicted in FIG. 4, in the third step, step 409, the hybrid train configuration system 200 uses the train configuration data 205 to determine whether the capacities of the secondary motive power sources of the provisional train configuration 115 are sufficiently large enough to allow the secondary motive power source(s) of the provisional train configuration 115 to provide the required battery supplement. If so, the hybrid train configuration system 200 concludes that the provisional train configuration is capable of completely traversing the anticipated train route 103, and the method 300 ends with step 305, as described above. If not, the method 300 continues with step 308, as described above and below.

For example, FIG. 5 depicts a calculation of equivalent grades for the selecting of a train configuration 115 including at least one hybrid locomotive 102. In the example depicted in FIG. 5, the grade of an anticipated train route 103 is plotted for each point along the anticipated train route 103 as curve 501. As depicted in FIG. 5, the elevation (or grade) of the anticipated train route 103 increases and decreases along the anticipated train route 103. In this example, the ruling grade of the anticipated train route 103 is the last local maximum, R1. As depicted in FIG. 5, G1 is the calculated equivalent grade of the continuous rated power of a provisional train configuration 115, and G2 is the calculated equivalent grade of the maximum hybrid power of the provisional train configuration 115. As described above, in some instances, to determine whether a provisional train configuration 115 is capable of completely traversing an anticipated train route 103, the hybrid train configuration system 200 first compares G1 to R1. In this example, G1 is less than R1; thus, as described above, the hybrid train configuration system 200 determines that the provisional train configuration 115 is not capable of completely traversing the anticipated train route 103 using only primary motive power sources. Next, in some instances, as described above, the hybrid train configuration system 200 compares G2 to R1. In this example, G2 is greater than R1; thus, as described above, the hybrid train configuration system 200 determines that the provisional train configuration 115 may be capable of completely traversing the anticipated train route 103 using a combination of primary and secondary motive power sources, pending an analysis of the capacities of the secondary motive power sources of the provisional train configuration 115. Then, in some instances, the hybrid train configuration system 200 integrates the marginal grade between G1 and the curve 501, represented in FIG. 5 by the cumulative elevation deficit 502, e.g., the sum of the shaded regions above G1 and below curve 501. Finally, in some instances, the hybrid train configuration system 200 converts the cumulative elevation deficit 502 into a required battery supplement and determines whether the capacities of the secondary motive power sources of the provisional train configuration 115 are sufficiently large enough to allow the secondary motive power sources to overcome the cumulative elevation deficit 502, e.g., if the capacities of the battery system of one or more ESSs 107 of the provisional train configuration 115 are large enough to provide the required battery supplement.

In some instances, after calculating a required battery supplement and determining that the capacities of one or more battery banks of one or more ESSs 107 are sufficiently large enough to allow the one or more ESSs 107 to provide the required battery supplement, the hybrid train configuration system 200 can determine a surplus battery energy from the capacities of the one or more battery systems. For example, in some instances, the hybrid train configuration system 200 determines a surplus battery energy from the capacities of the one or more battery systems by determining a maximum combined capacity of the one or more battery systems and subtracting the required battery supplement from the maximum combined capacity. The hybrid train configuration system 200 can then output the surplus battery energy in terms of elevation, such as by reversing the operation used to convert the cumulative elevation deficit 502 into a required battery supplement. Conversely, in some instances, after calculating a required battery supplement and determining that the capacities of the one or more battery systems are not sufficiently large enough to allow the one or more ESSs 107 to produce the required battery supplement, the hybrid train configuration system 200 can identify one or more battery charging opportunities along the anticipated train route 103. The hybrid train configuration system 200 can then determine whether additional battery energy potentially provided to the one or more battery banks by the one or more charging opportunities, combined with the capacities of the one or more battery systems, will exceed the required battery supplement. If so, instead of determining that the provisional train configuration 115 is not capable of completely traversing the anticipated train route 103, the hybrid train configuration system 200 can determine that the provisional train configuration 115 is capable of completely traversing the anticipated train route 103 and prompt a GUI 114 to display a corresponding visual indication, e.g., along with a visual indication of one or more necessary charging opportunities. Charging opportunities may include catenary systems, regenerative braking, charging stations, etc.

In some instances, as described above and below, after determining that a provisional train configuration 115 is not capable of completely traversing an anticipated train route 103, the hybrid train configuration system 200 may generate a recommended train configuration 210 that is capable of completely traversing the anticipated train route 103. In some instances, as mentioned above in reference to FIG. 2, a recommended train configuration 210 may alternatively or additionally include one or more deficiencies 215. For example, in some instances, after determining that a provisional train configuration 115 is not capable of completely traversing an anticipated train route 103, the hybrid train configuration system 200 can determine one or more deficiencies 215 of the provisional train configuration 115, e.g., one or more factors or reasons that caused the hybrid train configuration system 200 to determine that the provisional train configuration 115 is not capable of completely traversing the anticipated train route 103. The hybrid train configuration system 200 can then output the one or more deficiencies 215 and prompt a GUI 114 to display a visual indication of the one or more deficiencies 215. A visual indication of a deficiency may be referred to as a deficiency indication 602, as illustrated in FIG. 6.

For example, in some instances, if the reason that the hybrid train configuration system 200 determined that a provisional train configuration 115 is not capable of completely traversing an anticipated train route 103 is because the equivalent grade (G2) of the maximum hybrid power of the provisional train configuration 115 is less than the ruling grade (R1) of the anticipated train route 103, the hybrid train configuration system 200 can output "maximum hybrid power too low" as a deficiency 215 of the provisional train configuration 115 and prompt a GUI 114 to display a corresponding deficiency indication 602, as illustrated in FIG. 6. Or, for example, the hybrid train configuration system 200 can calculate the difference between the equivalent grade (G2) of the maximum hybrid power and the ruling grade (R1) of the anticipated route 103 and output the difference in grade as the deficiency 215 of the provisional train configuration 115. The hybrid train configuration system 200 can then prompt a GUI 114 to display a visual indication of the difference in grade, as illustrated in FIG. 6.

Or, for example, in some instances, if the reason that the hybrid train configuration system 200 determined that a provisional train configuration 115 is not capable of completely traversing an anticipated train route 103 is because the battery capacities of one or more ESSs 107 included in the provisional train configuration 115 are not sufficiently large enough to allow the ESSs 107 of the provisional train configuration 115 to provide a required battery supplement, the hybrid train configuration system 200 can output "battery capacities too low" as a deficiency 215 of the provisional train configuration 115 and prompt a GUI 114 to display a corresponding deficiency indication 602. Or, for example, the hybrid train configuration system 200 can calculate the difference between the required battery supplement and the battery capacities of the provisional train configuration 115 and output the difference as the deficiency 215 of the provisional train configuration 115. The difference between a required battery supplement and the battery capacities of a provisional train configuration 115 may be referred to as a "battery deficiency." The hybrid train configuration system 200 can then prompt a GUI to display a corresponding deficiency indication representing the battery deficiency. In some instances, the hybrid train configuration system 200 can convert and output the battery deficiency in terms of elevation, such as by reversing the operation described above used to convert the cumulative elevation deficit 502 into a required battery supplement.

FIG. 6 illustrates a graphical user interface 114 of a hybrid train configuration system 200. As mentioned above, in various instances, a hybrid train configuration system 200 is operative to receive route data 204, such as an anticipated train route 103, and train configuration data 205, such as a provisional train configuration 115. In some instances, as illustrated in FIG. 6, the hybrid train configuration system 200 can receive or display route data 204 and train configuration data 205 via a graphical user interface (GUI) 114, e.g., a GUI provided or otherwise accessed by the hybrid train configuration system 200. As described above, in various instances, after receiving route data 204 and train configuration data 205, the hybrid train configuration system 200 can use the route data 204 and the train configuration data 205 to determine whether a provisional train configuration 115 is capable of completely traversing an anticipated train route 103. For example, in the example illustrated in FIG. 6, the provisional train configuration 115 displayed by the GUI 114 includes two different hybrid locomotives 102 (e.g., Hybrid Locomotive A and Hybrid Locomotive B, as described below) and three virtually identical non-powered cars 101, and is being evaluated by the hybrid train configuration system 200 for its ability, or lack thereof, to traverse the entirety of the anticipated train route 103. In some instances, as illustrated in FIG. 6, after determining whether a provisional train configuration 115 is capable of completely traversing an anticipated train route 103, the hybrid train configuration system 200 can output a configuration viability indication 211 indicating that the provisional train configuration 115 is capable of completely traversing the anticipated train route 103 and prompt a GUI 114 to display a corresponding visual indication 601. Additionally, or alternatively, as illustrated in FIG. 6, if the hybrid train configuration system 200 determines that a provisional train configuration 115 is not capable of completely traversing an anticipated train route 103, the hybrid train configuration system 200 can determine one or more deficiencies of the provisional train configuration 115, as described above, and prompt a GUI 114 to display a corresponding deficiency indication 602. As illustrated in FIG. 6, in some instances, the hybrid train configuration system 200 can prompt a GUI 114 to display a deficiency indication 602 in terms of power or elevation (grade). For example, in the example illustrated in FIG. 6, the provisional train configuration 115 is deficient by 500 HP or 1.2% in grade.

As mentioned above, in various instances, the hybrid train configuration system 200 generates a recommended train configuration 210. For example, in some instances, as mentioned above, if the hybrid train configuration system 200 determines that a provisional train configuration 115 is not capable of completely traversing an anticipated train route 103, the hybrid train configuration system 200 can generate a recommended train configuration 210 that is capable of completely traversing the anticipated train route 103. For example, if the hybrid train configuration system 200 determines that the equivalent grade of the maximum hybrid power of the provisional train configuration 115 is less than the ruling grade of the anticipated train route 103, the hybrid train configuration system 200 can generate a recommended train configuration 210 for which the equivalent grade of the maximum hybrid power is greater than the ruling grade of the anticipated train route 103. In some instances, when generating a recommended train configuration 210, the hybrid train configuration system 200 confirms that the locomotives 102 and cars 101 to be included in the recommended train configuration 210 will compose a configuration that is capable of completely traversing an anticipated train route 103 by performing or repeating one or more of the steps of method 300, as described above, using the locomotives 102 and cars 101 to be included in the recommended train configuration 210 in place of the provisional train configuration 115 for which the recommended train configuration 210 is being generated.

As mentioned above, in some instances, to generate a recommended train configuration 210, the hybrid train configuration system 200 obtains available vehicle inventory data 206. The hybrid train configuration system 200 can then use route data 204, train configuration data 205, and the available vehicle inventory data 206 to generate a recommended train configuration 210. In some instances, the hybrid train configuration system 200 receives or displays available vehicle inventory data 206 via a GUI 114.

For example, as illustrated in FIG. 6, a particular railway system, ABC Railway, uses two types of hybrid locomotives 102: 1) Hybrid Locomotive A, which has a maximum horsepower of the primary motive power source (e.g., a fuel-consuming engine) of 5,000 HP, a maximum additional horsepower of the secondary motive power source (e.g., a battery bank) of 500 HP, and weighs 600 tons; and 2) Hybrid Locomotive B, which has a maximum primary horsepower of 3,000 HP, a similar maximum additional secondary horsepower of 500 HP, and weighs 500 tons. In this example, ABC Railway would like to send a train 100 including three non-powered cars 101 collectively weighing 10,000 tons and a single Hybrid Locomotive A (hereinafter, "ABC Provisional Train Configuration") on an anticipated train route 103 for which the ruling grade (R1) is 1.1%. Using a standard minimum velocity of 10 mph, the hybrid train configuration system 200 calculates the equivalent grade (G1) of the continuous rated power of ABC Provisional Train Configuration to be 0.88% and the equivalent grade (G2) of the maximum hybrid power to be 0.97%; thus the hybrid train configuration system 200 determines that ABC Provisional Train Configuration will not be capable of completely traversing the anticipated train route 103. In this example, however, the hybrid train configuration system 200 is able to access available vehicle inventory data 206 from ABC Railway. With the available vehicle inventory data 206, the hybrid train configuration system 200 determines that ABC Railway has only one available Hybrid Locomotive A (e.g., the Hybrid Locomotive A already provisionally included in ABC Provisional Train Configuration) and three available Hybrid Locomotive Bs. In this example, as illustrated in FIG. 6, the hybrid train configuration system 200 generates a recommended train configuration 210 that removes the Hybrid Locomotive A from ABC Provisional Train Configuration and adds two Hybrid Locomotive Bs. By doing so, although the recommended train configuration 210 gains a net weight of 400 tons (10,600 tons-600 tons+(2)(500 tons)), the equivalent grade (G2) of the maximum hybrid power of the recommended train configuration 210 increases to 1.19%, which is now greater than the ruling grade (R1) of the anticipated train route 103. Furthermore, the recommended train configuration 210 optimizes ABC Railway's operations by keeping the lone Hybrid Locomotive A, which possesses the superior tractive power, in ABC Railway's available vehicle inventory 116. However, the hybrid train configuration system 200 may generate a recommended train configuration 210 in any other way.

In some instances, the hybrid train configuration system 200 can prioritize one or more factors when generating a recommended train configuration 210. For example, when generating a recommended train configuration 210, the hybrid train configuration system 200 can prioritize using the fewest locomotives possible, or using the least amount of potential motive power possible, e.g., the lowest possible continuous rated power. Or, for example, when generating a recommended train configuration 210, the hybrid train configuration system 200 can prioritize minimizing an amount of anticipated emissions from the recommended train configuration 210, e.g., if the train configuration data 205 includes emissions data for locomotives. Or, for example, when generating a recommended train configuration 210, the hybrid train configuration system 200 can prioritize maximizing an amount of anticipated surplus battery energy. In some instances, when generating a recommended train configuration 210, the hybrid train configuration system 200 can prioritize two or more factors simultaneously. For example, in some instances, when generating a recommended train configuration 210, the hybrid train configuration system 200 can simultaneously prioritize using the fewest locomotives possible and maximizing an amount of anticipated surplus battery energy. The hybrid train configuration system 200 can then generate a recommended train configuration 210 that optimizes for both priorities. In some instances, when generating a recommended train configuration 210, the hybrid train configuration system 200 prioritizes one or more factors by default. In some instances, a user of the hybrid train configuration system can instruct the hybrid train configuration system 200 to prioritize one or more factors when generating a recommended train configuration 210.

In some instances, the hybrid train configuration system 200 need not determine whether a provisional train configuration 115 is capable of completely traversing an anticipated train route 103 before generating a recommended train configuration 210. For example, in some instances, the hybrid train configuration system 200 can receive route data 204 including an anticipated train route 103, train configuration data 205 including only one or more non-powered cars 101, and available vehicle inventory data 206, and, using the route data 204, the train configuration data 205, and the available vehicle inventory data 206, generate a recommended train configuration 210 including the one or more non-powered cars 101 and one or more hybrid locomotives 102 identified from the available vehicle inventory data 206 that is capable of completely traversing the anticipated train route 103, without first determining whether a provisional train configuration 115 including the one or more non-powered cars 101 is capable of completely traversing the anticipated train route 103. In this way, a user of the hybrid train configuration system 200 need not first do the work of proposing an entire train configuration 115, but can instead simply submit an anticipated train route 103 and one or more desired non-powered cars 101 to the hybrid train configuration system 200, and, if the hybrid train configuration system 200 has access to available vehicle inventory data 206, the hybrid train configuration system 200 can generate and return to the user a recommended train configuration 210 including the one or more desired non-powered cars 101 and at least one locomotive 102 that is certain to be capable of completely traversing the anticipated train route 103. The hybrid train configuration system 200 can then prompt a GUI 114 to display the recommended train configuration 210. Furthermore, as described above, the recommended train configuration 210 generated by the hybrid train configuration system 200 can be automatically optimized according to one or more priorities, such as minimizing emissions or maximizing surplus battery energy.

Similarly, in some instances, the hybrid train configuration system 200 can receive route data 204 including an anticipated train route 103, train configuration data 205 including one or more non-powered cars 101 and one or more traditional, or non-hybrid, locomotives, and available vehicle inventor data 206. In such an instance, the hybrid train configuration system 200 can then use the route data 204, the train configuration data 205, and the available vehicle inventory data 206 to generate a recommended train configuration 210 including the one or more non-powered cars 101 and one or more hybrid locomotives 102 identified from the available vehicle inventory data 206 that is capable of completely traversing the anticipated train route 103. In this way, the hybrid train configuration system 200 can replace one or more traditional, or non-hybrid, locomotives included in a provisional train configuration 115 with one or more hybrid locomotives 102, or add one or more hybrid locomotives 102 to a provisional train configuration 115 that includes one or more traditional, or non-hybrid, locomotives, and thereby increase the efficiency or viability of the provisional train configuration 115.

As described above, in various embodiments, a hybrid train configuration system 200 can determine whether a provisional train configuration 115 is capable of completely traversing an anticipated train route 103. As mentioned above, such a method is typically performed before the assembly of any actual train, and, by extension, before the operation of any actual train. However, as mentioned above, many of the features of the present disclosure can be applied to actual trains, and to actual trains currently in operation, e.g., on-board or remotely. For example, in some instances, the hybrid train configuration system 200 can receive route data 204, such as the remainder of a train route 103 in progress, or the position of a train along the train route 103; train configuration data 205, such as a train configuration 115 representing the composition or sequence of one or more non-powered cars 101 and one or more powered hybrid locomotives 102 of a train 100 currently in operation; and real-time train data, such as real-time estimations of charge states of one or more battery systems, associated with a train 100 currently in operation along a train route 103. For example, the hybrid train configuration system 200 may be executed on a controller 112 on-board the train 100, or on a computing device that is communicatively coupled to the train 100. In some instances, using the route data 204, the train configuration data 205, and the real-time train data, the hybrid train configuration system 200 can determine, for example, a surplus battery energy from the battery systems of the train 100, such as by comparing the real-time charge states of the battery systems to a required battery supplement, as described above. For example, in some instances, the hybrid train configuration system 200 can determine a surplus battery energy by calculating an equivalent grade of the continuous rated power of the train 100, integrating the marginal grade between the equivalent grade of the continuous rated power and the grade of the train route 103 along each point along the remainder of the train route 103, using the result of the integration to calculate a required battery supplement, determining real-time charge states of one or more ESSs 107 of the train 100, and subtracting the required battery supplement from the real-time charge states of the one or more ESSs 107. In some instances, the hybrid train configuration system 200 can then output the surplus battery energy and prompt a GUI 114 to display the surplus battery energy. As described above, in some instances, the hybrid train configuration system 200 can output and prompt a GUI 114 to display the surplus battery energy in terms of elevation. After the hybrid train configuration system 200 outputs and prompts a GUI 114 to display the surplus battery energy, an operator of the train 100 can then use the displayed surplus battery energy in making operational decisions for the train 100. For example, if the surplus battery energy is large enough, the operator might decide to use a secondary motive power source instead of a primary motive power source for one or more segments of the remainder of the train route 103, e.g., in order to conserve fuel. Or, for example, in some instances, after determining the surplus battery energy of a train, the hybrid train configuration system 200 can communicate with a controller 112 on the train 100 and autonomously direct the train 100 to use a secondary motive power source instead of a primary motive power source for one or more segments of the remainder of the route 103, without any operator involvement.

The hybrid train configuration system 200 disclosed herein allows for a train configuration 115 to be selected with a minimal amount of hybrid locomotives 102. Doing so can not only improve fuel efficiency, but also increase the number of locomotives effectively available to a railway system, thereby generating additional operational flexibility for the railway system and increasing the return on the railway system's assets. In some instances, he hybrid train configuration system 200 can additionally or alternatively be used to expedite the process of selecting hybrid locomotives 102 for a train configuration 115 and thereby improve the operational efficiency of a railway system that employs the hybrid train configuration 200. In some instances, the hybrid train configuration system 200 can additionally or alternatively be used to ensure that a hybrid train configuration 115 includes enough motive power to completely traverse an anticipated train route 103.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. For example, while the disclosure explains providing both a configuration viability indication and a recommended train configuration (with or without deficiencies), the system may arranged to only provide one of these outputs, e.g. only the viability indication. It is intended that the specification and examples be considered as exemplary only, with a true scope of the disclosure being indicated by the following claims and their equivalents.

What is claimed is:

1. An off-board system for configuring a train having at least one hybrid locomotive, the off-board system comprising at least one processor operative to:

receive an anticipated train route;

receive a proposed train configuration, prior to assembly of an actual train associated with the proposed train configuration, the proposed train configuration including the least one hybrid locomotive, wherein the at least one hybrid locomotive includes at least one internal combustion engine and at least one energy storage system;

determine whether the proposed train configuration is capable of completely traversing the anticipated train route; and in response to determining that the proposed train configuration is capable of completely traversing the anticipated train route, cause a graphical user interface (GUI) to display a visual indication that the proposed train configuration is capable of completely traversing the anticipated train route.

2. The system of claim 1, wherein the at least one processor is further operative to, in response to determining that the proposed train configuration is not capable of completely traversing the anticipated train route, generate a recommended train configuration that is capable of completely traversing the anticipated train route and cause the GUI to display the recommended train configuration.

3. The system of claim 2, wherein the at least one processor is further operative to generate the recommended train configuration at least in part by accessing an available vehicle inventory database.

4. The system of claim 2, wherein the at least one processor is further operative to generate the recommended train configuration at least in part by minimizing an amount of anticipated emissions from the recommended train configuration along the anticipated train route.

5. The system of claim 2, wherein the recommended train configuration comprises at least one hybrid locomotive comprising at least one internal combustion engine and at least one energy storage system and wherein the at least one processor is further operative to generate the recommended train configuration at least in part by maximizing an amount of anticipated surplus battery energy from the at least one energy storage system along the anticipated train route.

6. The system of claim 1, wherein the at least one processor is further operative to, in response to determining that the proposed train configuration is not capable of completely traversing the anticipated train route, determine a deficiency of the proposed train configuration and cause the GUI to display the deficiency for the proposed train configuration.

7. The system of claim 1, wherein the anticipated train route comprises one or more graded segments and wherein the at least one processor is further operative to determine whether the proposed train configuration is capable of completely traversing the anticipated train route at least in part by:

determining a steepest graded segment from the one or more graded segments;

determining a maximum hybrid power of the at least one hybrid locomotive;

determining an equivalent grade of the maximum hybrid power; and determining whether the equivalent grade of the maximum hybrid power is greater than the grade of the steepest graded segment.

8. The system of claim 7, wherein the at least one processor is further operative to determine whether the proposed train configuration is capable of completely traversing the anticipated train route at least in part by:

determining a continuous rated power of the at least one hybrid locomotive;

determining an equivalent grade of the continuous rated power;

integrating the difference between the equivalent grade of the continuous rated power and one or more grades of the one or more graded segments along the anticipated train route to determine a required battery supplement; and determining whether the at least one hybrid locomotive possesses the required battery supplement.

9. The system of claim 8, wherein the at least one processor is further operative to, in response to determining that the at least one hybrid locomotive possesses the required battery supplement, determine a surplus battery energy from the at least one hybrid locomotive along the anticipated train route and prompt the GUI to display the surplus battery energy.

10. The system of claim 8, wherein the at least one processor is further operative to identify one or more charging opportunities along the anticipated train route and determine whether additional battery energy potentially provided by the one or more charging opportunities combined with a battery capacity of the at least one hybrid locomotive exceeds the required battery supplement.

11. A method for configuring a train comprising at least one hybrid locomotive, the method comprising:

receiving an anticipated train route;

receiving a proposed train configuration, prior to assembly of an actual train associated with the proposed train configuration, the proposed train configuration comprising at least one hybrid locomotive including an internal combustion engine and an energy storage system including a battery system;

determining whether the proposed train configuration is capable of completely traversing the anticipated train route; and in response to determining that the proposed train configuration is capable of completely traversing the anticipated train route, causing a graphical user interface (GUI) to display a visual indication that the proposed train configuration is capable of completely traversing the anticipated train route.

12. The method of claim 11, wherein the anticipated train route comprises one or more graded segments and wherein determining whether the proposed train configuration is capable of completely traversing the anticipated train route further comprises:

determining a steepest graded segment from the one or more graded segments;

determining a maximum hybrid power of the at least one hybrid locomotive;

determining an equivalent grade of the maximum hybrid power; and determining whether the equivalent grade of the maximum hybrid power is greater than the grade of the steepest graded segment.

13. The method of claim 12, wherein determining whether the proposed train configuration is capable of completely traversing the anticipated train route further comprises:

determining a continuous rated power of the at least one hybrid locomotive;

determining an equivalent grade of the continuous rated power;

integrating the difference between the equivalent grade of the continuous rated power and one or more grades of the one or more graded segments along the anticipated train route to determine a required battery supplement; and determining whether the at least one hybrid locomotive possesses the required battery supplement.

14. The method of claim 13, further comprising, in response to determining that the at least one hybrid locomotive possesses the required battery supplement, determining a surplus battery energy from the at least one hybrid locomotive along the anticipated train route and prompting the GUI to display the surplus battery energy.

15. The method of claim 13, further comprising identifying one or more charging opportunities along the anticipated train route and determining whether additional battery energy potentially provided by the one or more charging opportunities combined with a battery capacity of the at least one hybrid locomotive exceeds the required battery supplement.

16. A method for configuring a train comprising at least one hybrid locomotive, the method comprising:

receiving an anticipated train route;

receiving a proposed train configuration, prior to assembly of an actual train associated with the proposed train configuration, the proposed train configuration comprising at least one non-powered car and at least one locomotive;

generating a recommended train configuration that is capable of completely traversing the anticipated train route, the recommended train configuration comprising the at least one non-powered car and at least one hybrid locomotive including an internal combustion engine and an energy storage system; and causing a graphical user interface to display the recommended train configuration.

17. The method of claim 16, wherein generating the recommended train configuration further comprises accessing an available vehicle inventory database.

18. The method of claim 16, wherein generating the recommended train configuration further comprises accessing a route information database and cross-referencing the anticipated train route with the route information database.

19. The method of claim 16, wherein generating the recommended train configuration further comprises minimizing an amount of anticipated emissions from the recommended train configuration along the anticipated train route.

20. The method of claim 16, wherein generating the recommended train configuration further comprises maximizing an amount of anticipated surplus battery energy from the at least one energy storage system along the anticipated train route.

* * * * *